US007878815B2

(12) United States Patent
Lung

(10) Patent No.: US 7,878,815 B2
(45) Date of Patent: Feb. 1, 2011

(54) ELECTRICAL CONNECTOR ASSEMBLED INTO A HINGE

(75) Inventor: Ssu-Min Lung, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/386,117

(22) Filed: Apr. 14, 2009

(65) Prior Publication Data

US 2009/0258510 A1 Oct. 15, 2009

(30) Foreign Application Priority Data

Apr. 14, 2008 (TW) ..... 97206307

(51) Int. Cl.
*H01R 39/00* (2006.01)

(52) U.S. Cl. ..... 439/31; 439/165

(58) Field of Classification Search ..... 439/668, 439/669, 165, 31

See application file for complete search history.

(56) References Cited

U.S. PATENT DOCUMENTS 3,860,312 A * 1/1975 Gordon, Jr. ..... 439/31
5,681,176 A * 10/1997 Ibaraki et al. ..... 439/165
6,471,546 B1 * 10/2002 Zhu et al. ..... 439/668
7,001,184 B2 * 2/2006 Abouchar ..... 439/13
7,418,279 B2 * 8/2008 Takagi ..... 455/575.1
7,433,467 B2 * 10/2008 Yi ..... 455/575.3

* cited by examiner

*Primary Examiner*—Briggitte R Hammond
(74) *Attorney, Agent, or Firm*—Ming Chieh Chang; Wei Te Chung; Andrew C. Cheng

(57) ABSTRACT

An electrical connector (100) assembled into a hinge (200), includes an insulative housing (1) defining a receiving cavity (110) running through a mating face (114) thereof and a plurality of contacts (2, 3) received and retained in the housing. The housing defines a plurality of receiving grooves (1251, 1252, 1253) running through a rear face (125) opposite to the mating face and communicating with the receiving cavity and at least one arc shaped side face (113) connecting with the mating face. The contacts are received and retained in the corresponding receiving grooves. Each of the contacts (2) defines a retaining portion (21), a contacting portion (22) extending forwards from the retaining portion and projecting into the receiving cavity, and a soldering portion (23) extending downwards from the retaining portion and received in the hinge.

14 Claims, 4 Drawing Sheets

ELECTRICAL CONNECTOR ASSEMBLED INTO A HINGE

BACKGROUND OF THE INVENTION

1. Field of the Invention

The present invention relates to an electrical connector, and especially to an electrical connector assembled into a hinge for multifunction.

2. Description of the Related Art

Electrical connectors are widely used in an electronic product for multifunction. The electrical connectors are usually arranged on a PCB disposed in an electronic product. Nowadays, too many electrical connectors are retained to the PCB, but there is no more room for more electrical connectors. Therefore, how to set more electrical connectors in a limited room of the electronic product is important for every manufacturer.

Hence, an electrical connector assembled into a hinge of an electronic product is invented for multifunction.

SUMMARY OF THE INVENTION

Accordingly, an object of the present invention is to provide an electrical connector assembled into a hinge for multifunction.

In order to achieve the object set forth, an electrical connector assembled into a hinge, includes an insulative housing defining a receiving cavity running through a mating face thereof and a plurality of contacts received and retained in the housing. The housing defines a plurality of receiving grooves running through a rear face opposite to the mating face and communicating with the receiving cavity and at least one arc shaped side face connecting with the mating face. The contacts are received and retained in the corresponding receiving grooves. Each of the contacts defines a retaining portion, a contacting portion extending forwards from the retaining portion and projecting into the receiving cavity, and a soldering portion extending downwards from the retaining portion and received in the hinge.

Other objects, advantages and novel features of the invention will become more apparent from the following detailed description of the present embodiment when taken in conjunction with the accompanying drawings.

DETAILED DESCRIPTION OF THE INVENTION

Figure 1:
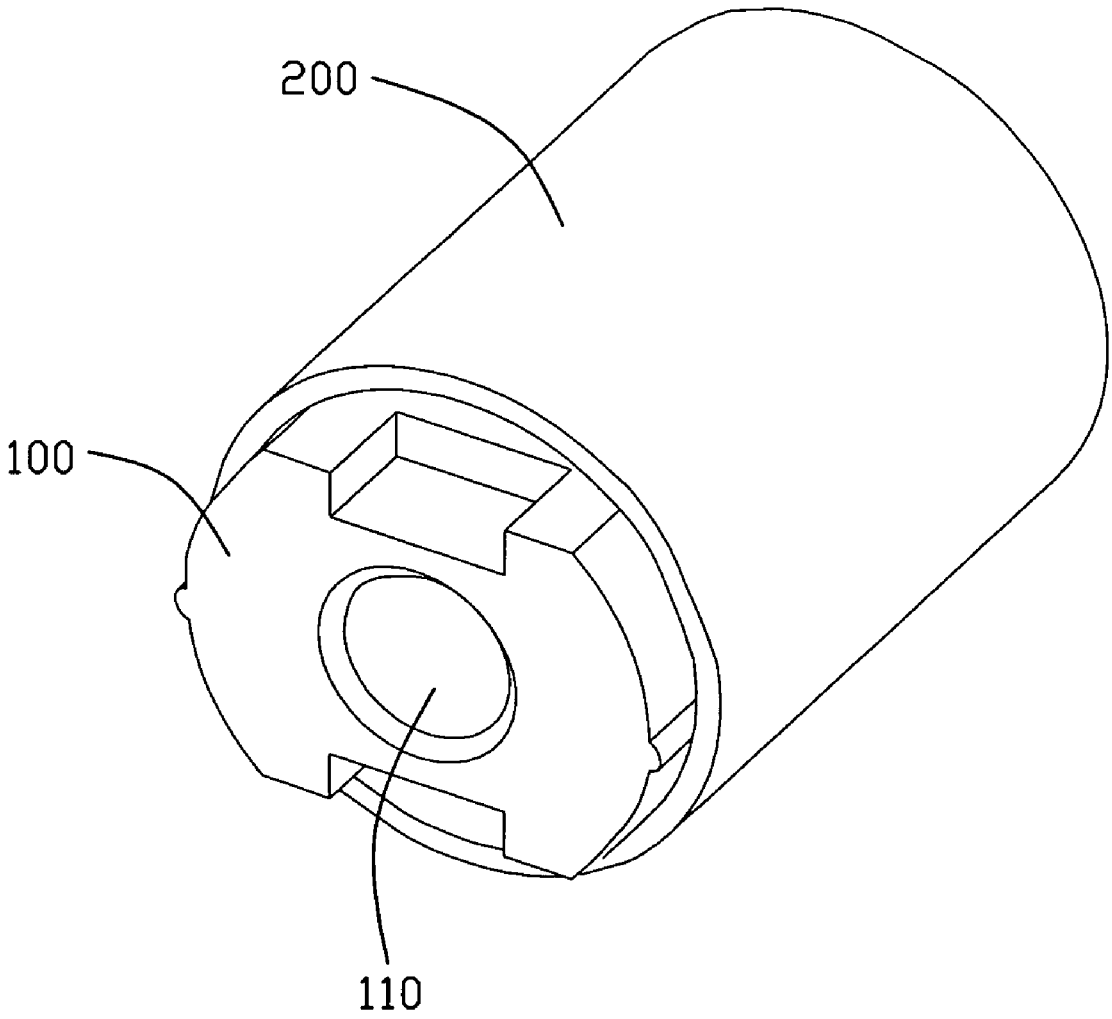
FIG. 1 is a front perspective view of an electrical connector assembled into a hinge.

Reference will now be made to the drawing figures to describe a preferred embodiment of the present invention in detail.

Referring to FIG. 1 to FIG. 4, disclosed here is an electrical connector 100 made in accordance with the present invention. The electrical connector 100 is assembled into a sleeve 200 disposed in an electronic product such as mobile telephone, and in this embodiment, the sleeve 200 is defined as a hinge disposed in an electronic product. The connector 100 includes an insulative housing 1, a plurality of contacts received in the housing 1 and a retaining member 4. The plurality of contacts includes a center contact 2 and a grounding contact 3 in this embodiment.

Figure 3:
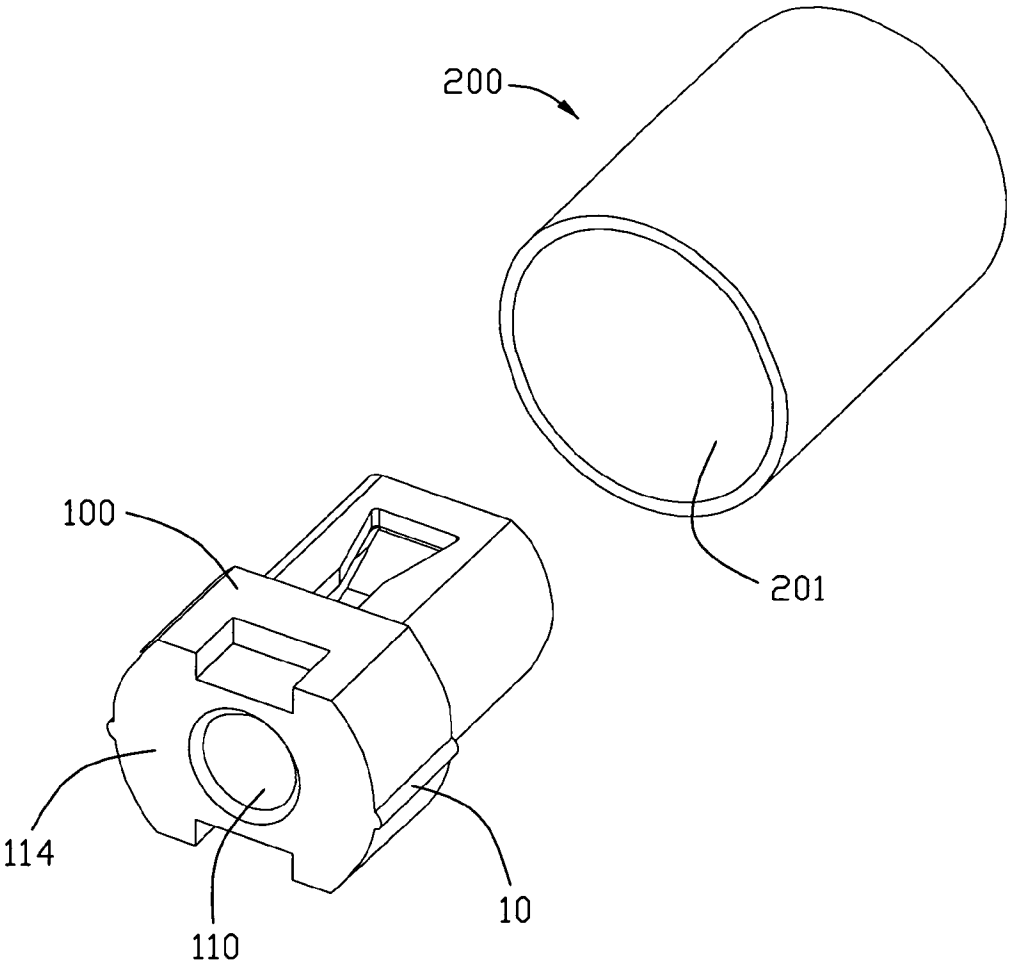
FIG. 3 is a front perspective view of the electrical connector separating from the hinge.
Figure 4:
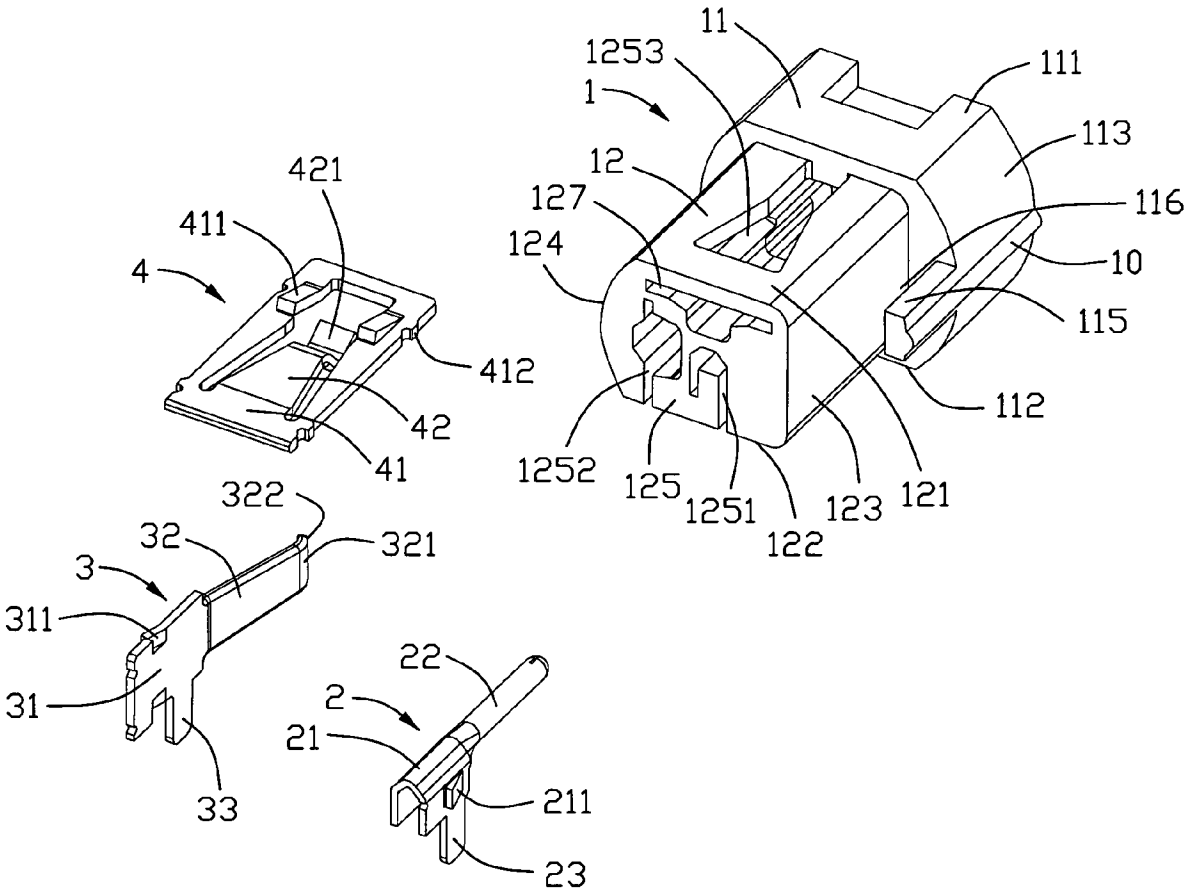
FIG. 4 is a rear exploded view of the electrical connector shown.

Referring to FIG. 3 and FIG. 4, the insulative housing 1 defines a first portion 11 and a smaller second portion 12 extending rearwards from the first portion 11. The first portion 11 defines a flat top face 111, a flat bottom face 112 opposite and parallel to the top face 111, a pair of arc shaped side faces 113 connecting to the top and bottom faces 111, 112 and a front face 114. The first portion 11 is defined as a mating portion, and the front face 114 is defined as a mating face. The mating portion 11 provides a mating cavity 110 for receiving a mating connector running through the mating face 114 thereof. The side faces 113 each defines a projecting portion 10 extending along a front-to-rear direction at a middle portion thereof.

The second portion 12 defines a flat top face 121, a flat bottom face 122 opposite and parallel to the top face 121, a pair of side faces 123, 124 connecting to the top and bottom face 121, 122 and a rear face 125 opposite to the mating face 110 of the mating portion 11. One of the side faces 123 is a flat plane and vertical to the top and bottom faces 121, 122, and the other side face 124 is arc shaped. The size of the mating portion 11 is larger than that of the second portion 12, and the top face 111, the bottom faces 112 and the side faces 113 of the first/mating portion 11 extend beyond the corresponding top face 121, bottom faces 122 and side faces 123 of the second portion 12. The second portion 12 defines three receiving grooves 1251, 1252, 1253 running through the rear face 125 and communicating with the receiving cavity 110. The first and second receiving grooves 1251, 1252 run through the bottom face 122 of the second portion 12, and the first receiving groove 1251 defines an n-shaped portion. The third receiving groove 1253 runs through the top face 121 of the second portion 12. The mating portion 11 defines a retaining arm 115 extending rearwards from the arc shaped side face 113 adjacent to the flat side face 123 of the second portion 12. The retaining arm 115 is spaced from the flat side face 123 and a slot 116 is provided therebetween, and other components (such as a FPC) may be set in the slot 116. The projecting portion 10 is partly disposed on the retaining arm 115.

Referring to FIG. 4, the center contact 2 defines an n-shaped retaining portion 21, a columned contacting portion 22 extending forwards from the retaining portion 21 and a soldering portion 23 extending downwards from the retaining portion 21. The center contact 2 is inserted into the first receiving groove 1251 from the rear face 125 thereof, and the retaining portion 21 is retained in the corresponding n-shaped portion, the contacting portion 22 projects into the receiving cavity 10, and the soldering portion 23 extends out of the second portion 12. The elastic piece 211 on the retaining portion 21 may engage with the inner surface of the first receiving groove 1251 to retain the center contact 2 to the housing 1 steadily.

The grounding contact 3 defines a flat retaining portion 31, an elastic arm 32 extending forwards from a front end of the retaining portion 31 and towards the receiving cavity 110 and a soldering portion 33 extending downwards from the retaining portion 31. The elastic arm 32 defines a contacting portion 321 with a guiding face 322 at the free end thereof. The grounding contact 3 is retained to the second receiving groove 1252 by the elastic pieces 311 engaging with the inner surface thereof, and the contacting portion 321 projects into the receiving cavity 110 and the soldering portion 33 extends out of the second portion 12.

The retaining member 4 defines a flat retaining portion 41 and a contacting arm 42 extending slantways and downwards from an inner side edge of the retaining portion 41. The retaining member 4 is retained into the third receiving groove 1253 by the elastic pieces 411 extending upwards from a top surface of the retaining portion and the barbs 412 projecting outwards from side lateral thereof engaging with inner surfaces of the third receiving groove 1253. The contacting arm 42 defines a bended contacting portion 421 at a free end thereof. The contacting arm 42 extends towards the receiving cavity 110 and the contacting portion 421 projects into the receiving cavity 110.

Figure 2:
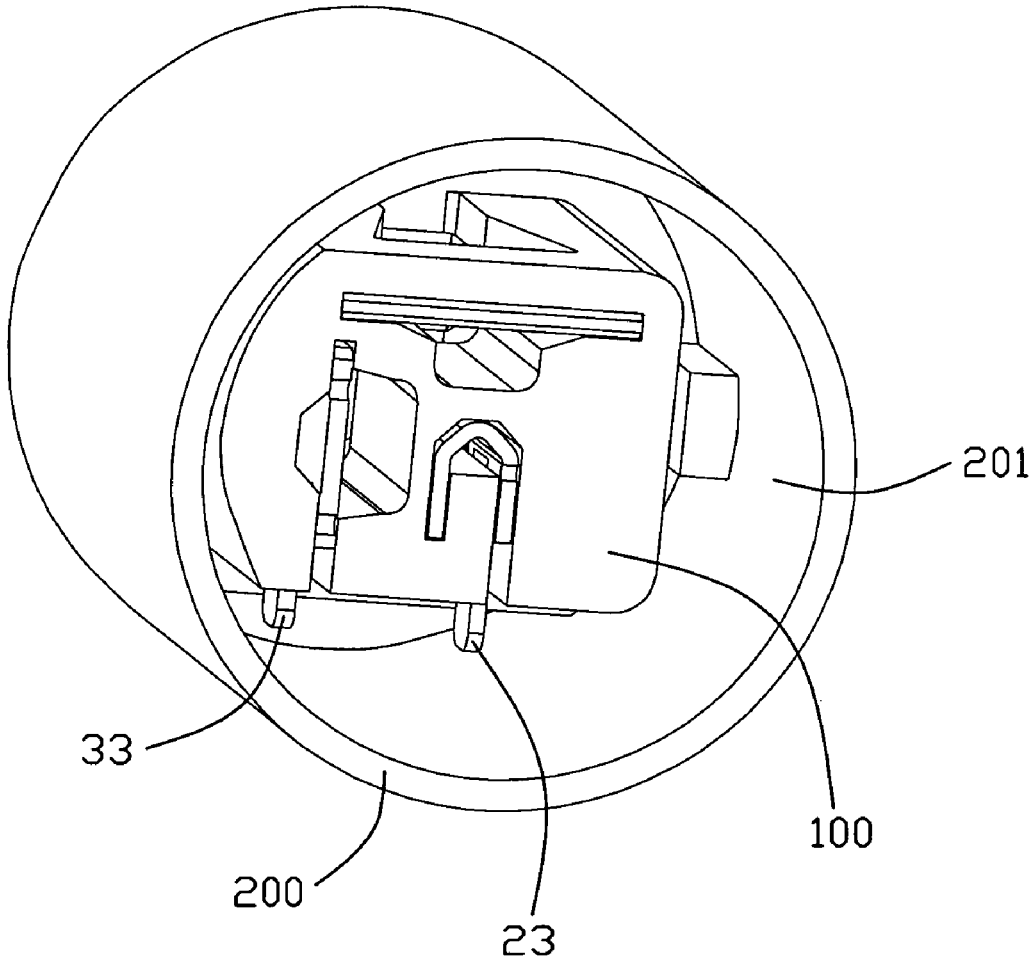
FIG. 2 is a rear perspective view of the electrical connector shown in FIG. 1.

Referring to FIG. 1 to FIG. 3, the sleeve 200 defines a columned receiving room 201 at a middle portion thereof. The electrical connector 100 is received in the receiving room 201 with the arc shaped side faces 133, 134 attaching to the arc shaped inner surface of the receiving room 201, and is retained in the receiving room 201 by the projecting portion 10 engaging with the inner surface. The soldering portions 23, 33 are received in the receiving room 201 and can be soldered to a FPC disposed in the receiving room. The present electrical connector 100 retained in the sleeve 200 instead of being arranged on a PCB of an electronic product as a conventional connector may save the room of the PCB for other components, which is suit for miniaturization and multifunction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembled into a sleeve, comprising:

an insulative housing defining a receiving cavity running through a mating face thereof, a plurality of receiving grooves running through a rear face opposite to the mating face and communicating with the receiving cavity and at least one arc shaped side face connecting with the mating face; and a plurality of contacts received and retained in the housing, each of the contact defining a retaining portion, a contacting portion extending forwards from the retaining portion and projecting into the receiving cavity, and a soldering portion extending downwards from the retaining portion and received in the sleeve;

wherein the housing defines a mating portion providing the mating face and a smaller second portion extending rearwards from the mating portion, and the mating portion defines a pair of opposite arc shaped side faces;

wherein the mating portion and second portion each define a flat top face and an opposite flat bottom face, and the top and bottom faces of the mating portion are respectively disposed beyond the corresponding top and bottom faces of the second portion.

2. The electrical connector as described in claim 1, wherein the at least one arc shaped side face defines a projecting portion thereon.

3. The electrical connector as described in claim 1, wherein the soldering portions extend downwards from the second portion.

4. The electrical connector as described in claim 1, wherein the second portion defines a flat side face, and the at least one arc shaped side face adjacent to the flat side face is disposed beyond the flat side face.

5. The electrical connector as described in claim 4, wherein the mating portion defines a retaining arm extending rearwards from the arc shaped side face, and a slot is provided between the retaining arm and the flat side face.

6. The electrical connector as described in claim 1, wherein the contacts define a center contact and a grounding contact.

7. An electrical connector assembly comprising:

a sleeve defining a receiving room therein; and an electrical connector assembled into the receiving room, comprising:

an insulative housing defining a mating portion and a smaller second portion extending rearwards from the mating portion, and the mating portion engaging with the receiving room and defining a receiving cavity running through a mating face thereof and the second portion defining a plurality of receiving grooves communicating with the receiving cavity; and a plurality of contacts retained in the corresponding receiving grooves, each of the contacts defining a retaining portion, a contacting portion extending forwards from the retaining portion and projecting into the receiving cavity, and a soldering portion received in the receiving room;

wherein the mating portion defines a pair of opposite arc shaped side faces attaching to the inner surface of the receiving room, and each arc shaped side face defines a projecting portion thereon.

8. The electrical connector assembly as described in claim 7, wherein the soldering portions extend downwards from the second portion.

9. The electrical connector assembly as described in claim 8, wherein the second portion defines a flat side face, and one of the arc shaped side faces adjacent to the flat side face is disposed beyond the flat side face.

10. The electrical connector assembly as described in claim 9, wherein the mating portion defines a retaining arm extending rearwards from the arc shaped side face adjacent to the flat side face of the second portion, and a slot is provided between the retaining arm and the flat side face.

11. The electrical connector assembly as described in claim 10, wherein the projecting portion is partly disposed on the retaining arm.

12. An electrical connector comprising:

an insulative housing defining a central mating cavity extending along a front-to-back direction;

a contact receiving center passage extending from a rear face of the housing toward the mating cavity;

a contact receiving side passage extending from the rear face of the housing toward the mating cavity;

a retainer receiving top passage extending from the rear face of the housing toward the mating cavity;

a center contact inserted into the center passage from the rear face and exposed to the mating cavity;

a side contact inserted into the side passage from the rear face and expose to the mating cavity; and a retainer inserted into the top passage from the rear face and exposed to the mating cavity; wherein said center contact, said side contact and said retainer commonly impose forces upon an inserted plug; wherein a top face of the housing is removed to expose the retainer so as to allow a spring tang of the retainer to be upward and outwardly deflected once the plug is inserted into the mating cavity.

13. The electrical connector as claimed in claim 12, wherein each of the center contact and the side contact includes a solder tail exposed outside of a bottom face of the housing.

14. The electrical connector as claimed in claim 13, wherein a sleeve surrounds the housing includes a protective sleeve covering the housing including said solder tails of the center contact and the side contact.

* * * * *